United States Patent [19]

Munk

[11] Patent Number: 4,768,927

[45] Date of Patent: Sep. 6, 1988

[54] ADJUSTABLE FOLDING PROPELLER

[75] Inventor: Torben Munk, Virum, Denmark

[73] Assignee: Confol ApS, Helsingør, Denmark

[21] Appl. No.: 40,781

[22] PCT Filed: Jul. 1, 1986

[86] PCT No.: PCT/DK86/00078

§ 371 Date: Mar. 10, 1987

§ 102(e) Date: Mar. 10, 1987

[87] PCT Pub. No.: WO87/00140

PCT Pub. Date: Jan. 15, 1987

[30] Foreign Application Priority Data

Jul. 2, 1985 [DK] Denmark ..... 2996/85

[51] Int. Cl.[4] ..... B63H 1/24

[52] U.S. Cl. ..... 416/142; 416/87; 416/212 R

[58] Field of Search ..... 416/142 A, 142 R, 142 B, 416/87, 89, 212 R

[56] References Cited

U.S. PATENT DOCUMENTS

| | | | |
|---|---|---|---|
| 1,878,816 | 9/1932 | Bucklen | 416/207 |
| 2,500,382 | 3/1950 | Rowley . | |
| 4,086,025 | 4/1978 | Astrand | 416/142 A |
| 4,275,991 | 6/1981 | Söderbaum | 416/142 A |
| 4,364,711 | 12/1982 | Brandt et al. | 416/142 A |
| 4,427,341 | 1/1984 | Eichler | 416/142 |
| 4,565,531 | 1/1986 | Kimon | 416/142 A |

FOREIGN PATENT DOCUMENTS

| | | | |
|---|---|---|---|
| 65092/80 | 1/1985 | Australia . | |
| 804531 | 2/1951 | Fed. Rep. of Germany . | |
| 2349929 | 4/1974 | Fed. Rep. of Germany | 416/142 A |
| 381234 | 12/1975 | Sweden . | |
| 407552 | 4/1979 | Sweden . | |
| 1268577 | 3/1972 | United Kingdom | 416/142 A |

*Primary Examiner*—Everette A. Powell, Jr.

*Attorney, Agent, or Firm*—Merchant, Gould, Smith, Edell, Welter & Schmidt

[57] ABSTRACT

Folding propeller which consists of blades (1) hinged to a hub (7) in such a way that they can turn about 56 degrees from a position at rest, where they are pointing aft, to a working position towards a stop. The identical movements of the blades (1) are achieved by the use of two cog-wheel connections, where each cog-wheel consists of only one tooth. The two connections are arranged side by side but in opposite directions in order to ensure a fixed connection. The tooth faces (10) may be given the shape of an arc of a circle. The propeller blades (1) may be fixed to the hub mechanism by means of pins (2) arranged in the longitudinal axis of the blades (1). The pitch of the blades (1) may then be changed.

4 Claims, 4 Drawing Sheets

ADJUSTABLE FOLDING PROPELLER

This invention relates to so-called folding propellers which are screw propellers with foldable blades and are intended for use on sailing boats equipped with an engine for auxiliary propulsion.

Sailing boat propellers where the blades are hinged at the hub and take up a normal position perpendicular or nearly perpendicular to the driving shaft when the ship is propelled by the engine but which are folded up by the water pressure when the ship is using sails alone with the engine stopped, have been known for a long time under the name of folding propellers. The advantage of folding up the propeller blades is that the relatively high resistance of a stopped propeller, or of a propeller driven very slowly around by passing water, is avoided.

The hinged blades of nearly all types of folding propellers are in some way mechanically connected to each other in order to ensure that the positions of the blades are identical as they move from the position at rest to the working position and vice versa. This is very important, because different positions of the blades will bring the propeller out of balance and thus create dangerous vibrating forces. The most common way to ensure the identical movements of the blades is to arrange cog-wheel sectors at the hub end of the blades. The shafts, on which the blades are hinged to the hub, are then arranged in such a way that the cog-wheel sectors are in mesh with each other or with a common cog-rod. A movement of one blade will then cause a similar movement of the other blade or the other blades.

There are however a number of disadvantages connected with this type of folding propeller.

The centrifugal force will move the blades from the position at rest to a position perpendicular to the driving shaft when the engine is started and the hydrodynamic force on the blades will try to pull them either forward or backward depending on the direction of the rotation. A certain position of the blades in the working condition can easily be obtained when the propeller is driving the boat forward, by arranging stops which prevent the blades from moving further forward. A similar arrangement is however not possible when the propeller has to drive the boat astern. The hydrodynamic force will then try to fold up the propeller and the blades will only remain in a position suitable for propulsion if the centrifugal force on a blade is large compared to the hydrodynamic force. Unfortunately, it is not possible from practical reasons to make the blades so heavy that they will remain perpendicular or nearly perpendicular to the driving shaft under all backing conditions and the final position of the blades will therefore be one where the centrifugal forces and the hydrodynamical forces are counterbalancing each other. This position of equilibrium is not well determined because it is strongly affected by the propeller blade geometry and the hydrodynamic working conditions. The virtual diameter of the propeller which is smaller than the maximum diameter because of the inclination of the blades may therefore be too small resulting in a reduced performance of the propeller.

Further, it is not easy to manufacture the cog-wheel sectors at the end of the blades and there are difficulties in making them sufficiently strong. They are therefore exposed to fractures and heavy wear and the blades will then have to be scrapped.

The folding propeller, according to the present invention, is characterised by the stops which only allow the blades to turn about 56 degrees from the position at rest to the working position and by the cog-wheel mechanism which consists of only two teeth per blade placed side by side, one a little offset from the other. Only one face of each tooth is used and for two teeth of one blade it will be the opposite sides.

The centrifugal force will pull the blades out to the working position when the driving shaft rotates. The turning moment of the centrifugal force around the hinge shaft of a blade is, according to simple and well-known physical and geometrical laws, at a maximum when the blades are turned 45 degrees out from the position at rest but is significantly reduced whenthe blades are turned to about 60 degrees. The hydrodynamic activity of the propeller is however, at an optimum, when the angle is 90 degrees and the virtual diameter of the propeller is as large as possible, but is significantly reduced when the turning angle of the blades is less than 60 degrees. A good compromise between an efficient hydrodynamic performance and the ability to stay in the working position against the stop when going astern is therefore achieved when an angle of about 60 degrees is chosen for the working position.

The cog-wheel connection between the blades is, as mentioned before, made with only one tooth per blade and this tooth is continuously meshed with the tooth of the opposite wheel. Cog-wheels with only one set of corresponding teeth will, however, only stay together if the torque, which has to be transferred from one shaft to the other, is pressing the two teeth against each other. It is therefore necessary to arrange a similar pair of teeth besides the first pair, but directed in the opposite way, if a fixed connection, independent of the direction of the torque and power transfer, is required.

A cog-wheel connection with only one pair of teeth in mesh will have a limited working angle. The above-mentioned working angle of 60 degrees is therefore slightly reduced to about 56 degrees in order to ease the design of the mechanism.

A propeller according to this invention has a number of advantages:

A minimum of material may be used for the blades, because they are fixed in a position, where the ability of the centrifugal force to keep the propeller folded out is at a maximum.

A performance like that of a fixed bladed propeller is achieved, because the blades remain in the same position going astern as when going forward.

The number of teeth in mesh is reduced to one per blade for each turning direction and only one face of a tooth is used. There is therefore no requirements for the thickness of the teeth so they may be given a simple and rugged shape which eases the manufacture and permits the use of materials with low strength.

The folding propeller according to the present invention, in its most simple form, differs mainly from the well-known types in two ways. Firstly by the angular position in which the blades are fixed during propulsion ahead and astern and secondly by the connection of the blades using a special cog-wheel mechanism, where only one face of the tooth is used. It may however, according to the invention, be advantageous to give the face of the teeth the shape of an arc of a circle. This is a reasonably good approximation to the normally used curve of evolution but, in the present case, whereonly one face of a tooth is used, it will further be possible to replace the teeth by circular cylinders which are fixed in such a way that the working part of the cylinder surface is kept free.

Moreover, it is, according to this invention, possible to manufacture the propeller blades seperately and to connect them to the hub mechanism by means of pins arranged in the longitudinal axis of the blades. The seperation of the different parts, which is achieved in this way, will make the manufacture of the propeller easy and cheap and will make it possible to replace parts in case of extensive wear or damage, thus avoiding total scrapping of the propeller.

Finally, it will, according to this invention, be advantageous to arrange the beforementioned pin for the connection of the blade to the hub mechanism in such a way that the blade may turn around it. Each pin must then be fixed to the hub mechanism by a bolt, which, when it is loosened, permits the blade to turn about 15 degrees. This corresponds to a change of pitch of the propeller blade between about 0.5 times the propeller diameter and about 1.2 times the propeller diameter. This is the pitch interval normally used for yacht propellers. In this way it is possible to adjust the propeller to suit the speed of the boat and the power and number of revolutions of the engine.

The drawings show an adjustable folding propeller according to the invention as follows.

Figure 1:
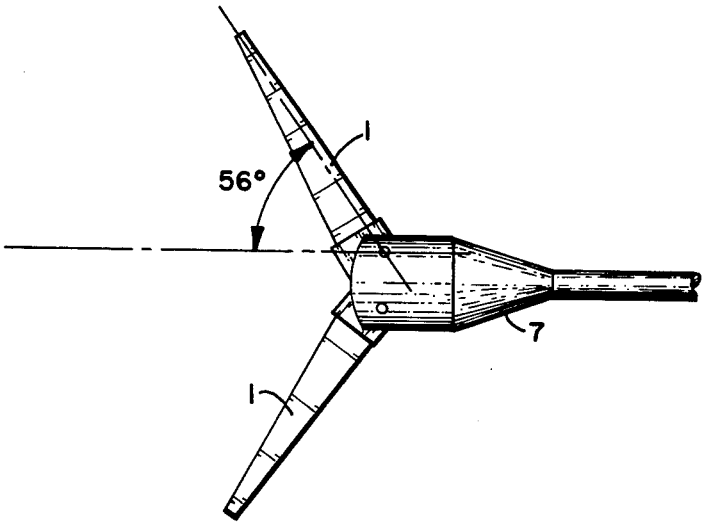
FIG. 1 shows the propeller during propulsion ahead and astern using the engine.
Figure 2:
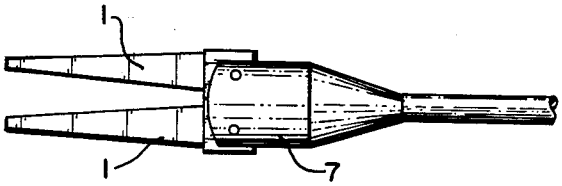
FIG. 2 shows the propeller at rest, when the engine is stopped and the boat is propelled using sails.
Figure 3:
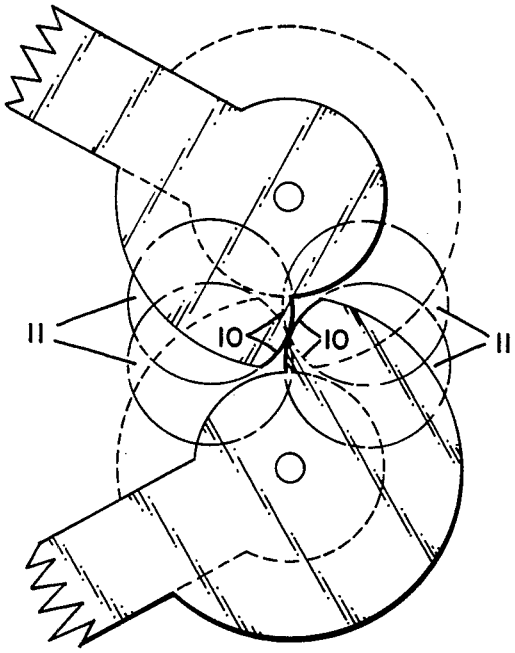
FIG. 3 shows the principles of the special cog-wheel connection of the blades with one part of the double-connection fully drawn and the other part dotted and with the positions of the four circular cylinders, which act as teeth, shown by a thin dot-and-dash line.
Figure 4A:
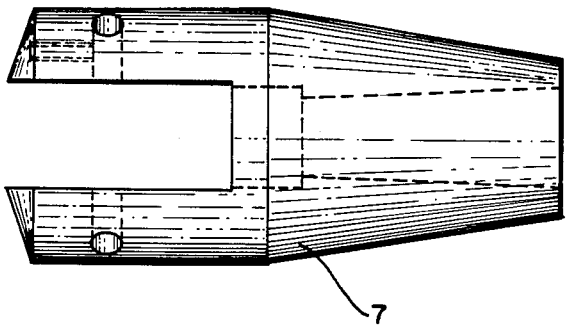
FIGS. 4A–4C show the propeller hub.
Figure 4B:
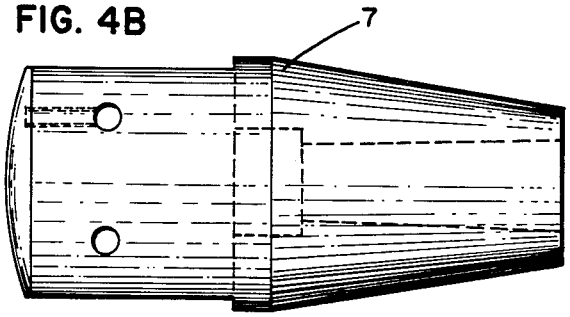
Figure 4C:
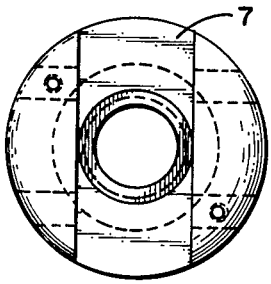
Figure 5A:
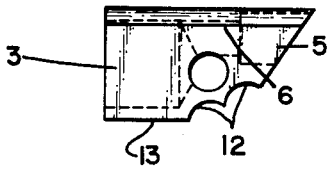
FIGS. 5A–5C show the part of the hub mechanism to which a blade is connected.
Figure 5C:
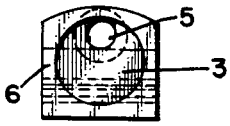
Figure 5B:
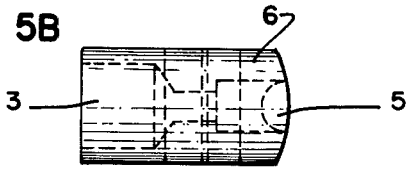

The propeller consists of two blades 1, each with a circular, cylindric pin 2 at the end, either directly manufactured with the blade or screwed into place. The pins are fastened in holes 3 by means of bolts 4 through holes 5 in the moving parts 6 of the hub mechanism. These moving parts are connected to the fixed part of the hub 7 by shafts 8, which are secured by screws 9. The moving parts of the hub mechanism are connected to each other by two cog-wheel connections placed side by side. Each cog-wheel connection consists only of one tooth face 10 on each wheel. In the case shown, the teeth are formed by circular cylinders 11 of a length equal to half the thickness of the moving parts of the hub mechanism. The cylinders are placed in holes 12 in the moving parts and may be fixed by brazing or in some other way. Stops for the movement corresponding to positions at rest or at work are made up by the surfaces 13 and 14.

I claim:

1. A folding propeller comprising a hub and a pair of adjacent blade components hinged thereto, each of said blade components being hingeably connected on two parallel hinging axes to said hub and each blade component having a pair of teeth, each tooth having one working face, and with said pair of teeth extending generally toward the other blade component, said teeth on one blade component being in a side by side relationship as seen along one hinging axis but being arcuately offset with the working faces of each tooth being arcuate in shape and following an arc reverse of its side by side counterpart, said teeth on the other blade component being likewise in a side by side relationship and arcuately offset so that said pairs of teeth are continuously in a meshed state with the adjacent blade component, so that all four working faces are simultaneously engaged with one meshed pair functional during folding and the other pair functional during unfolding when said blade components are caused to move between a folded position and an unfolded position.

2. A propeller according to claim 1 wherein said teeth each comprise a cylinder and wherein said blade components include arcuate recesses sized to receive said cylinders, and including means for affixing said cylinders in said recesses.

3. A propeller according to claim 1 wherein each of said blade components include a cog wheel portion having said teeth and a blade portion extending outwardly therefrom, said cog-wheel portion including a recess and said blade portion including a cylindrical element sized to be rotatably received in said recess, and means for securing said cylindrical element in said recess against rotation, so that the blade pitch can be selected and then maintained in position by said securing means.

4. A propeller according to claim 1 wherein the angular movement of the blade components from folded to operating positions is generally 60 degrees.

* * * * *

UNITED STATES PATENT AND TRADEMARK OFFICE

CERTIFICATE OF CORRECTION

PATENT NO. : 4,768,927

DATED : 6 September 1988

INVENTOR(S) : Torben Munk

It is certified that error appears in the above-identified patent and that said Letters Patent is hereby corrected as shown below:

Column 2, line 15, "whenthe" should be --when the--

Column 2, line 67, "whereonly" should be --where only--

Figure 6:
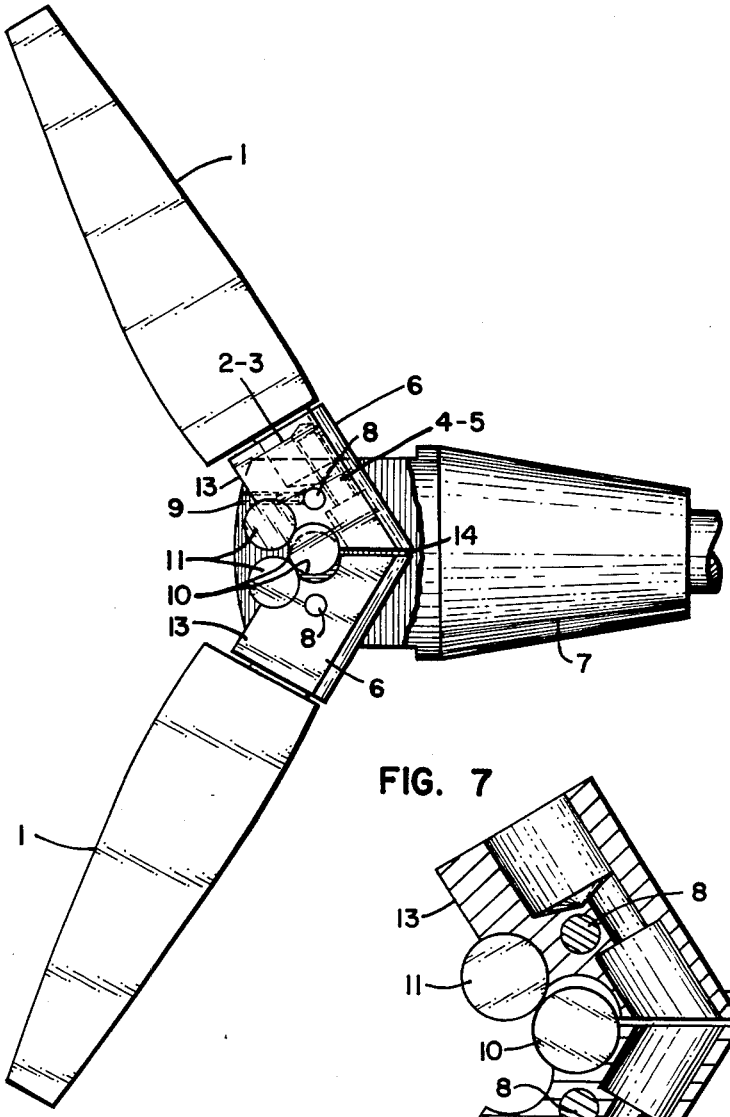
FIG. 6 shows an assembly drawing of the propeller, from which a part of the hub is removed in order to expose the mechanism and for which hidden contours are shown dotted for the upper blade only.
Figure 7:
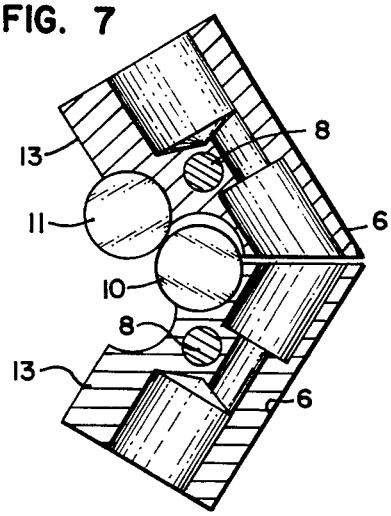

Column 3, after line 43, insert --Fig. 7 is a partial view like Fig. 6 except with portions broken away to expose lower cylinders 10 and 11 which are not visible from the top view in Fig. 6.--

Column 4, line 3, after the word "tooth" insert --(or working)--.

Signed and Sealed this

Twenty-first Day of March, 1989

*Attest:*

DONALD J. QUIGG

*Attesting Officer*

*Commissioner of Patents and Trademarks*